US005697175A

United States Patent [19]

Schwartz

[11] Patent Number: 5,697,175

[45] Date of Patent: Dec. 16, 1997

[54] LOW POWER DRAIN ILLUMINATED SIGN

[75] Inventor: Steven Schwartz, Ithaca, N.Y.

[73] Assignee: Spectralight, Inc., Ithaca, N.Y.

[21] Appl. No.: 472,432

[22] Filed: Jun. 7, 1995

Related U.S. Application Data

[63] Continuation-in-part of Ser. No. 135,252, Oct. 10, 1993, Pat. No. 5,448,843.

[51] Int. Cl.[6] ..... G09F 13/00

[52] U.S. Cl. ..... 40/552; 40/570; 40/581; 362/800; 362/812

[58] Field of Search ..... 40/452, 550, 551, 40/570, 581, 552; 362/235, 347, 800, 812

[56] References Cited

U.S. PATENT DOCUMENTS

| | | | |
|---|---|---|---|
| 796,475 | 8/1905 | Turner . | |
| 882,555 | 3/1908 | Doane | 40/550 |
| 1,152,146 | 8/1915 | Conner et al. | 40/551 |
| 1,536,449 | 5/1925 | Muller | 40/551 |
| 4,028,828 | 6/1977 | Chao et al. . | |
| 4,259,800 | 4/1981 | Schoenfeld . | |
| 4,854,062 | 8/1989 | Bayo | 40/551 |
| 4,967,317 | 10/1990 | Plumly . | |
| 4,970,812 | 11/1990 | Tanaka et al. | 40/550 X |
| 5,186,537 | 2/1993 | Katoh et al. . | |
| 5,299,109 | 3/1994 | Grondal | 40/570 X |
| 5,448,843 | 9/1995 | Schwartz | 40/570 |
| 5,539,623 | 7/1996 | Gurz et al. | 362/800 X |

FOREIGN PATENT DOCUMENTS

| | | | |
|---|---|---|---|
| 331224 | 9/1989 | European Pat. Off. | 40/551 |
| 463345 | 2/1914 | France | 40/570 |
| 210954 | 9/1960 | Germany | 362/235 |

*Primary Examiner*—Brian K. Green

*Attorney, Agent, or Firm*—Brown, Pinnisi & Michaels

[57] ABSTRACT

An illuminated sign apparatus comprised of a reflector with dedicated cavities. Each letter and, optionally, background area, comprises a shaped cavity, illuminated indirectly by a plurality of near-point sources such as light-emitting diodes located in the center of the cavity, either on a separate perpendicular circuit board or on a central projection formed in the bottom of the cavity, with the light emitted by the sources pointed outwards. In another embodiment, the letter cavities and background are illuminated by parallel boards along the top, bottom, and (optionally) middle of the letter cavities, with the light sources directed along the axes of the letter strokes. In another embodiment, the light sources in the center of the cavity are electroluminescent and ultraviolet emitting, and the cavity can be coated with a UV activated flourescent coating which is activated by the EL light source. The light is evenly reflected upward toward the viewer, giving the illusion of a solid letter or background. The cavities may be filled with a transparent substance.

11 Claims, 4 Drawing Sheets

LOW POWER DRAIN ILLUMINATED SIGN

REFERENCE TO RELATED APPLICATIONS

This is a continuation-in-part patent application of application Ser. No. 08/135,252, entitled "LOW POWER DRAIN ILLUMINATED SIGN", filed Oct. 10, 1993, now U.S. Pat. No. 5,448,843.

FIELD OF THE INVENTION

The invention pertains to the field of illuminated signs. More particularly, the invention pertains to signs, particularly "EXIT" signs, which are illuminated by a plurality of near-point-source low drain lights such as Light Emitting Diodes (LEDs), in which the sign presents a uniformly illuminated appearance.

BACKGROUND OF THE INVENTION

Every state in America has regulations concerning the installation of "EXIT" signs in public buildings. In large part, these regulations are the result of work done by the "Committee On Safety To Life" of the National Fire Protection Association (NPPA), which was first appointed in 1913. For the first few years of its existence, the Committee devoted its attention to a study of notable fires involving loss of life, and to analyzing the causes of that loss of life. This work led to the preparation of standards for the construction of stairways, fire escapes, and, over the years, to the suggested embodiment of the exit signs themselves.

Signs designed for alerting the public to safe exit from a building in case of emergency can range from a simple flat, non-illuminated plastic decal to the elaborate lighted designs generally seen in larger buildings. In such applications, the law requires an illuminated sign with a battery back-up system to guard against failure in the event of a power outage. Where there are a large number of such signs, power usage becomes a real concern.

The first powered EXIT signs utilized incandescent or florescent bulbs for their illumination source. These signs were simple and straightforward in their design, comprising single or dual incandescent or fluorescent white light bulbs in a box, with one side an opaque panel with the word "EXIT" cut out. A colored plastic sheet was placed between the light source and this panel. The colored plastic sheet served the dual purpose of giving color to the light output and affording a degree of diffusion to the light in an attempt to avoid hot spots in the signs appearance.

This attempt at even illumination is a stated objective of the NFPA code, paragraph 5-10.3.4. This section of the code states that "Every sign required by 5-10.1.4 shall provide evenly illuminated letters having a minimum luminance of 0.06 footlamberts."

Another common approach was to paint the word "EXIT" in one color on a contrasting translucent panel, placed in front of a light source. Local codes may specify certain colors, but by convention, the letters are usually red on a green background. As the entire light source transmission is directed to the face of the sign, it is accepted that this creates a more noticeable display. It is also understood that with the display being in two contrasting colors, greater recognizability, particularly in smoky conditions, is realized.

In a changing and competitive manufacturing economy, there are always new market forces which become the causative factors guiding the design of consumer products. In the case of EXIT, and indeed any electric sign, the cost of powering these appliances has become the prime concern governing their design and marketability. Towards this end, the Light Emitting Diode (LED) exit sign has come into use. These LED signs improve upon the operation of their predecessors. Bulb burnout is essentially eliminated. The light output of LEDs is high, while their power consumption is low, and their low voltage requirement is well suited to battery backup systems. However, there is one aspect to the LED sign which results in a drawback to their usage as a light source for signs of any type, particularly exit signs.

A principal object of this invention is to provide an LED sign which gives the display appearance of the higher power consumption but greater visibility incandescent or florescent signs.

Prior art LED signs utilize many lights (hundreds, in some applications), pointing outwards toward the viewer. Since LEDs are nearly point light sources, like small spot lights, their output being in the shape of a forwardly projecting cone, the appearance of such signs is that of many small dots (which I term "pointillist"). This quality makes it difficult for LED signs to conform to section 5-10.3.4 of the NFPA code described above, when used within their usual design constraints. The "evenly illuminated letters" of this section refers to the type of illumination which was attained in the past when one or several incandescent or florescent light sources were placed in a box with cut out or translucent panels as described above.

In view of the significant advantages realized by the use of LEDs, the NFPA has been allowing their use even though they give a "pointillist" nature to a sign's appearance, and forfeit having the entire face of the sign illuminated by two contrasting colors. The LED signs of the prior art utilize a variety of approaches to come as close as possible to attaining the appearance called for by the NFPA code which, while not stipulating any actual design methods, lead very strongly towards a back lit type of sign using a single or dual light source.

A further object of the invention is to utilize the LEDs in a manner whereby their "pointillist" output will be diffused to give the impression of even illumination of letters.

To approximate, as closely as possible, the appearance of these incandescent signs, manufactures of LED signs have taken two approaches. One is to have the front panel of the sign made of an opaque material, paint it with the desired word and have the center line of each stroke of each letter drilled with holes to accept LEDs penetrating this panel. These signs, because they add no diffusion to the generated light, tend to use LEDs which are themselves diffused to aid in affording as wide a viewing angle as possible. Others place focused LEDs behind a cut-out panel as in the conventional back lit signs previously described, but include another panel of a highly light diffusing material. This second approach actually represents the same approach as in the incandescent signs. There are also signs which place diffused LEDs behind clear panels.

These signs' major drawbacks are that they incorporate significant amounts of light loss due to the fact that they are illuminating the entire interior of the sign's housing. In addition, they are passing the light through multiple layers of materials, incorporating a reflective air space between each. This represents a light loss for each layer due to this reflectance. There are also losses involved due to mismatching between the wavelength of the generated light and the color temperature of the layered materials involved.

Another object of the invention is to provide an illuminated sign while minimizing reflective or absorptive losses of the generated light.

The approaches of incorporating LEDs to exit signs described above fall short of fulfilling the NFPA code completely and precisely. They are only capable of illuminating the letter stroke in an insufficient manner, and are incapable of giving illumination in a contrasting color to the area of the sign's face which is not letter stroke (termed the "background").

A further object of the invention is to provide a sign which is capable of illuminating the letter stroke and background area of the sign face separately in two or more contrasting colors.

A number of illuminated signs have been patented. The following examples are considered relevant to the invention.

Turner, U.S. Pat. No. 796,475, represents the most obvious method of illuminating a sign, similar to the large signs commonly seen in amusement parks or advertising signs. Individual lamps are mounted in a reflective channel given the shape of the desired letter. The lamps are incandescent, each having their own socket and wired together in parallel. The resultant appearance of letters constructed in this manner would be for them to have a pointillist quality. In other words, the hot spot of each light bulb would be very evident. FIG. 3 shows that there is some kind of transparent cover over the reflective channel, presumably to either give color to the emitted light, for protection or both. There are a number of disadvantages to this arrangement: Heat will build up, causing a shortened lamp or other component life; When light passes through even an apparently clear substance, there is a light loss of four percent or greater due to reflectance and absorption; and Turner's sign is constructed without the benefit of printed circuit board methods of manufacture, which automate much of the required assembly.

Chao, U.S. Pat. No. 4,028,828, teaches individual letters insertable into a powered track. The letters utilize light bulbs placed in direct line with the viewer's eye, creating hot spots. In this design there is also the condition, even more pronounced than in the above invention, of complete enclosure of the light bulbs, creating heat build up. In claim one of Chaos' invention, it states in line thirteen that the described characters must be hollow, which again creates the condition of the loss of illumination efficiency through reflectance and absorption. While this invention does utilize the advantage of printed circuit board fabrication, the PCB is a separate entity to the housing which comprises the reflector, or the portion of the embodiment which gives shape to the light being emitted.

Schoenfeld, U.S. Pat. No. 4,259,800, shows a sign in which transparent letters are masked out of an opaque cover, over asymmetrically shaped reflective chambers. These chambers are given a basic rectangular shape conforming to the major dimensions of height and width of the given character, but are not in the shape of the letters. The condition of the light passing through space and hitting a reflective surface is still evident, creating the transmittance loss mentioned previously. The bulbs illuminating the sign are positioned in a central location, but pointed directly at the viewer, creating hot spots, and also dull spots due to the fact that the outer regions of each character are positioned at maximum distances from the bulbs. In the detailed description, column three, third paragraph, Schoenfeld teaches that the lenses and the opaque mask around them should be cast out of a single material and covered with a paint or some other translucent substance. There is mention given to there being the ability of the different lenses changing color, but still the background of each letter will be of the same color, only of a different degree of brilliance.

Plumly, U.S. Pat. No. 4,967,317, shows a sign utilizing incandescent bulbs imbedded in a layer of plastic which diffuses and conducts the light to minimize the pointillist aspect of the bulbs. A face plate has an opaque layer which is cut out to form the letters. Largely, it falls into the same trap of losses due to the reasons mentioned above with the Schoenfeld sign.

My copending application, Ser. No. 08/135,252, entitled "LOW POWER DRAIN ILLUMINATED SIGN", of which this application is a continuation-in-part, shows a sign which addresses the objects noted above, but in a different form than the sign of this invention. Each letter and, optionally, background area, comprises a shaped cavity, illuminated indirectly by a plurality of near-point sources such as light-emitting diodes arranged around the periphery of the cavity, with the light emitted by the sources pointed inwards. The center of each cavity is formed of an opaque substance, formed into a convex shape or "hump" midway between the light sources around the edges of the area. The "hump" is slightly lower than the edges of the cavity, and the areas between the "hump" and the edges are approximately in the form of parabolas. The sources illuminate the "hump", and the light is evenly reflected upward toward the viewer, giving the illusion of a solid letter or background. While this design is very successful, the complex shape of the cavities and the need to insert and power point light sources in the sloping sides can introduce additional complexity and expense in manufacture. The sign as taught by the present application takes the parent application's concept of a cavity in the shape of a letter which is indirectly illuminated by point light sources a step further, simplifying the manufacturing process while still meeting the same design criteria of even illumination.

SUMMARY OF THE INVENTION

The invention is an LED-illuminated sign, especially applicable to exit signs, which optionally permits separate contrasting illumination of letters and background. Each letter and, optionally, background area, comprises a shaped cavity, illuminated indirectly by a plurality of near-point sources such as light-emitting diodes located in the center of the cavity, either on a central projection formed in the bottom of the cavity or on a separate perpendicular circuit board, with the light emitted by the sources pointed outwards. In another embodiment, the light sources may be located at the ends and/or center of the letter cavity, oriented along the letter axis. The light is evenly reflected upward toward the viewer, giving the illusion of a solid letter or background. The cavities may be filled with a transparent substance. In still another embodiment, the light sources in the center of the cavity are electroluminescent and ultraviolet emitting, and the cavity can be coated with a UV activated flourescent coating which is activated by the EL light source.

DESCRIPTION OF THE PREFERRED EMBODIMENT

Figure 1:
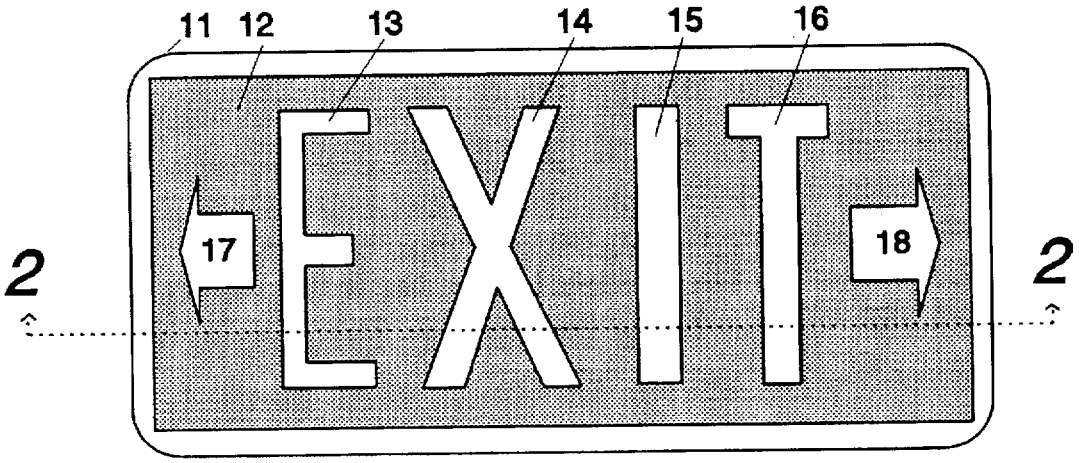
FIG. 1 shows a front view of the sign of the invention.

FIG. 1 shows the sign of the invention.

The design of the preferred embodiment lends itself to easy mounting, as will be seen. The sign itself is thin, and the electronics required to drive the sign light sources may be either mounted on the rear of the sign, or may be on a separate circuit board. In either case, relatively little space is needed for drivers, and the only additional space requirement on a mounting would be for a power supply and/or battery, if such are needed. The sign may be mounted on a box for mounting on a wall, or be mounted under a box for ceiling mounting, within the teachings of the invention. The details of the mounting are conventional, and form no part of the invention.

The sign is formed of a background area (12) (i.e. the area outside of letter strokes) and a plurality of letters (13) to (16), in this case forming the word "EXIT". In the EXIT sign application, it may be desired to include a pair of arrows (17) and (18), as will be seen below. Although the description of the preferred embodiment will hereafter be in terms of the "EXIT" sign application, it will be understood that the invention is not limited to these letters, only.

The sign will preferably be surrounded by a frame or mounting flange (11), and may have a cover of glass or plastic for protection (not shown).

Figure 2:
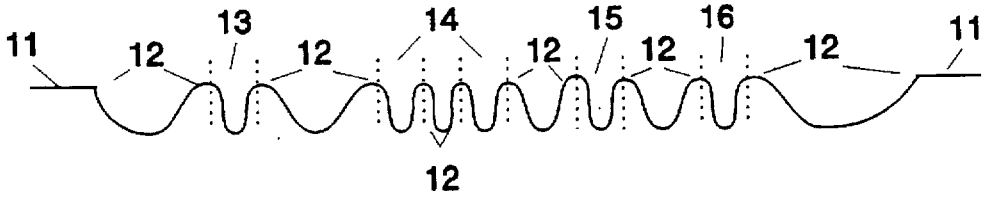
FIG. 2 shows a cut-away side view of the sign of the invention, along line 2—2 of FIG. 1.

The sign backing is illustrated in FIG. 2, which is a cross section through the sign along the line 2—2 in FIG. 1. This backing is molded into a specific shape, which make the objects of the invention possible.

The areas of the sign which form the mounting flange (11), background areas (12), and the letters "E" (13) , "X" (14), "I" (15), and "T" (16) are marked on FIG. 2. The part of the sign which makes up one stroke of a letter is detailed in FIG. 3.

Figure 3:
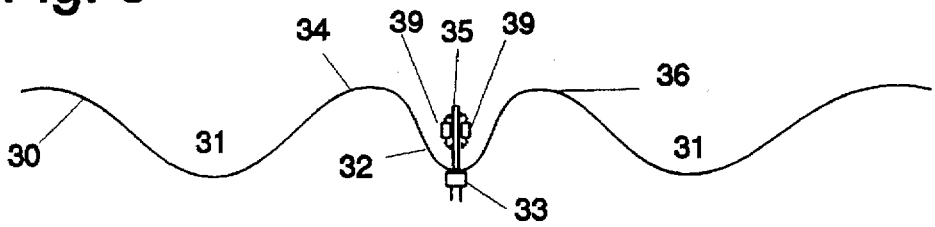
FIG. 3 shows a cut-away side view detail of a single section of a letter of the sign of the invention.

As can be seen in the detailed FIG. 3, each area (background, letter stroke, arrow) is formed by a trough molded into the backing (30), bordered by a relatively high projection—sections (34) and (36) forming the left and right boundaries of the letter stroke illustrated. The trough (32) between the edges (34) and (36) is preferably approximately parabolic in shape, although it could be a straight-sided "V" or "U" shape if manufacturing considerations require.

An array of point light sources, such as light-emitting diodes (LEDs) (39), is centrally mounted in the letter trough (32). In the preferred embodiment, the light sources (39) are surface-mount LEDs mounted upon both sides of a double-sided printed circuit board (35). The circuit board (35) connects through the backing (30) into a socket (33).

It will be understood by one skilled in the art that, while "LEDs" are the preferred light sources today, that other equivalent low drain point-source devices may be available or developed in the future and used within the teachings of the invention.

The light sources (39) shine outwards toward the edges (34) and (36) of the letter trough (32), rather than outwards toward the viewer as in the prior art. The edges reflect the light from the sources evenly forward toward the viewer, so that the viewer sees only the indirect illumination from the lighted troughs and not the direct pointillist light from the point light sources. This gives the even illumination required by the NFPA standard.

Because of the large reflecting area, the number of light sources needed to fill in the letter strokes evenly is far less than that required in prior art signs where the lights themselves are used to fill in the strokes. With the number of lights required being drastically reduced, the current drain of the sign is correspondingly reduced.

Figure 4:
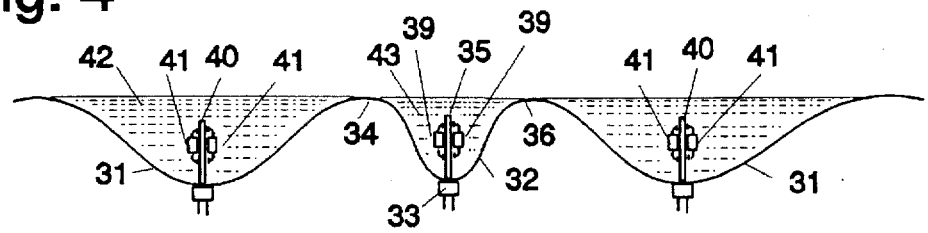
FIG. 4 shows a variation on the sign of FIG. 3, in which the letter and background are separately illuminated, and the cavity is filled with a transparent material.

The light from the sources may be additionally diffused, and the light sources protected, by filling the troughs with a transparent substance (42) and (43) as shown in FIG. 4, preferably a plastic resin chosen from the many available to the art. The resin is preferably colored the same as the LEDs, to aid in the diffusion and provide color when the lights are off. The resin in the letter stroke area and in the background area are preferably tinted in contrasting colors.

FIG. 4 shows the same detail as FIG. 3, in the preferred embodiment having the background areas (31) illuminated in a contrasting color to the letter strokes. This can be easily accomplished by adding additional light sources (42) on circuit boards (40) in the center of the background area troughs (31). The background illumination LEDs illuminate the edges of the background areas (31), in the same manner as described above for the letter strokes.

According to the code, the letter strokes and background areas should be illuminated in contrasting colors. This is easily accomplished by using commonly available red and green LEDs for the stroke and background illumination, respectively. In such a case, the troughs of the letter strokes will be filled with red-tinted resin (43), and the background areas filled with green-tinted resin (42).

Figure 6:
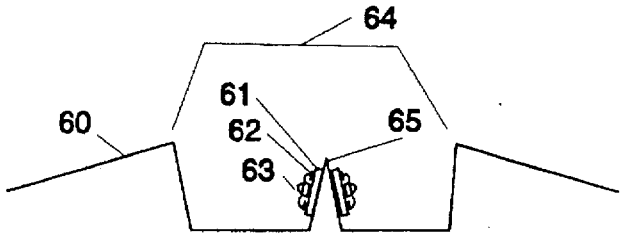
FIG. 6 shows another variation on the sign of the invention, in which the light sources are mounted on a central projection in the cavity rather than on a separate circuit board.

FIG. 6 shows an alternative to the plug-in circuit boards (35) and (40) of FIGS. 3 and 4. In this embodiment, the letter trough (64) has a central projection (65) formed in it. The light sources (63) are mounted on the sides of this projection. One approach which would allow this to be done easily in assembly is to mount surface-mount LEDs or the like on a flexible adhesive tape (61) having conductive traces (62) on its surface. Such tape is available from 3M, or common 2 or 4 conductor ribbon conductor could be attached with an adhesive.

Another possibility for color assignment is opened up if commonly available bi-color LEDs are used for the sources. These LEDs light in red if powered in one polarity, green in the opposite polarity, and yellow if fed with AC. This would allow the sign to be flashed in alternating red-and-green colors in case of an emergency.

Figure 7:
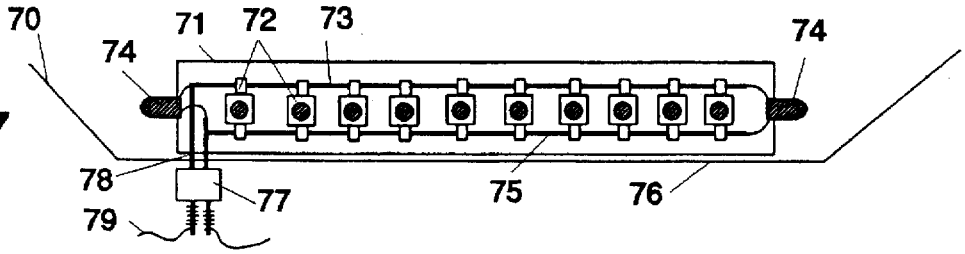
FIG. 7 shows one of the circuit boards with light sources mounted upon it as used by the sign of the invention.

FIG. 7 shows one side of a two-sided PC board (71) which could be used with the sign of the invention, as located in a letter trough (76). The ends of the trough (76) are sloped upward (70). Two parallel conductive traces (73) and (75) are spaced apart along the length of the board (71) an appropriate distance to allow surface-mount LEDs (72) to be placed on the board (71) and soldered to the traces. The traces connect to pins (78) which can extend through the bottom of the trough (76) into a socket (77). The power for the board is fed through wires (79) which can easily be wire-wrapped to the pins of the socket (77).

In order to fully illuminate the ends (70) of the trough (76), additional light sources (74) can be mounted on the ends of the board (71), pointing outward along the axis of the trough.

Figure 9:
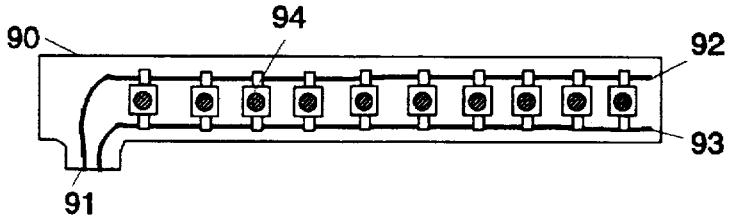
FIG. 9 shows an alternate embodiment of the circuit board of FIG. 7, in which the circuit board is flexible material.

In some applications, it is desirable that the circuit board should be bendable. This can be seen in FIG. 10, in which the upper circuit boards (109) in the letter "O" (102) are curved to fit the letter. FIG. 9 shows how a flexible board, such as is commonly used on the back of automobile instrument clusters, could be used. In this case, the traces (92) and (93) are extended to form a fingerstock (91) to match with an edge connector on the sign.

Figure 10:
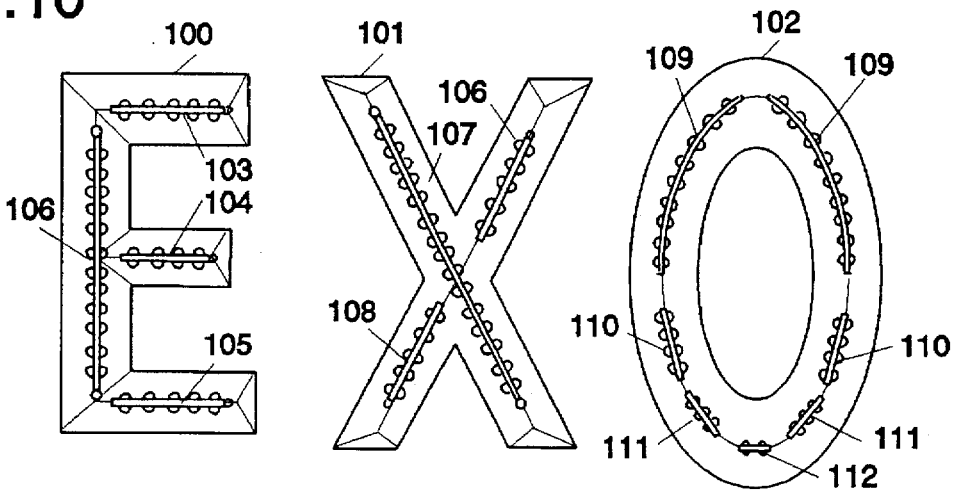
FIG. 10 shows a top view of several sample letters with circuit boards inserted.

If rigid boards are used in curved letters such as the "O" (102) in FIG. 10, a number of shorter boards (110)–(112) could be used to approximate the shape of the letter.

In straight letters such as the "E" (100) and "X" (101) in FIG. 10, or if the normally rounded letters are squared off in shape, rigid boards are not a problem in fitting the letter shape. A number of standard length boards could be developed to ease manufacture and allow for all of the alphabet to be easily formed. In the "E" (100), three sizes of boards are used—a long board (106), two medium boards (103) and (105) and a shorter board (104). The "X" (101) requires one long board (107) and two medium boards (106)(108), and so on.

Figure 8:
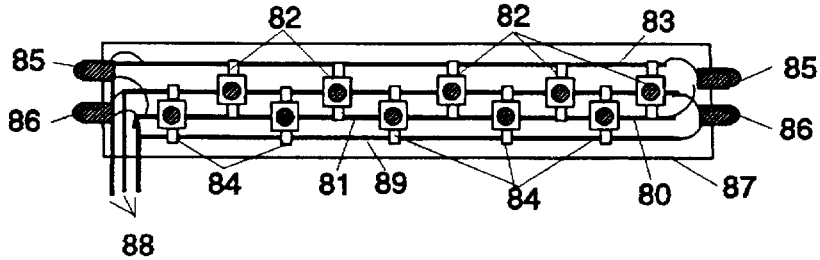
FIG. 8 shows an alternate embodiment of the circuit board of FIG. 7, with the capability of multiple color light sources.

FIG. 8 shows how two strings of single-color LEDs could be provided in contrasting colors in each area, and alternately powered to change the color. Instead of the two traces (73)(75) of FIG. 7, three or four traces (81)(83)(89) are used. Four traces are shown with the two (81) connected together, so as to allow easier automated placement of the LEDs. LEDs of two colors (82) and (84) are connected to alternate sets of traces, and three or four pins (88) allow powering either color set.

All of the strings of LEDs can be connected together, or preferably, the LEDs for the letters, background and arrows will be separately powerable.

Figure 11:
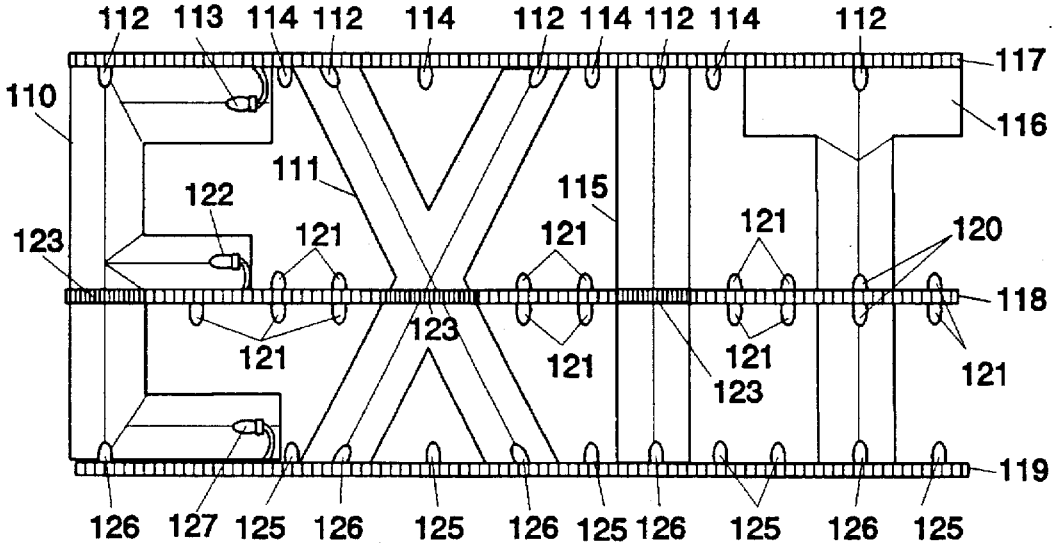
FIG. 11 shows a top view of the alternate embodiment of the invention, with light sources at the ends and center of the letter axis.
Figure 12:
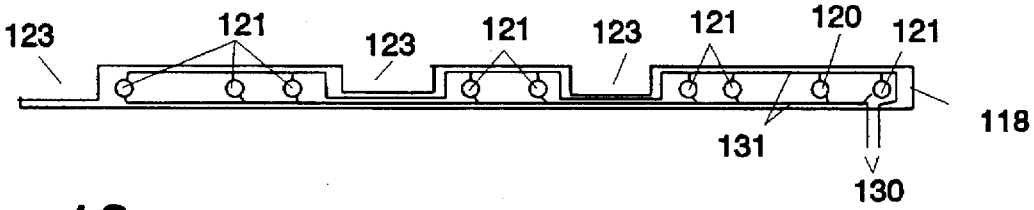
FIG. 12 shows a side view of the central circuit board from FIG. 11.

FIGS. 11 and 12 show another embodiment of the invention. In this embodiment, the illumination of the letter troughs and the background area is done from the ends of the letters and the edges of the background area, and, optionally, from the center of the sign.

FIG. 11 shows a top view of part of an "EXIT" sign made according to the teachings of the invention (the arrows, frame, cover, etc. are omitted for clarity. Each of the letters "E"(110), "X"(111), "I"(115) and "T"(116) are formed, as in the other embodiments of the invention, of troughs or cavities in the shape of the letters. The sides of the troughs face inward and may be gently sloped as shown in the earlier embodiments, or may meet in the center of the trough at an acute angle, or the troughs may even have a squared-off "U" shape.

A circuit board is run along the top (117) and bottom (119) of the letters. Each board has a number of point light sources such as LEDs mounted on it, aligned along the axes of the letters—LEDs (112) from the top, LEDs (126) from the bottom. For some letters, it may be necessary to extend a few LEDs to point parallel to the board, as is shown for the top (113), middle (122) and bottom (127) stroke of the "E"(110). Other LEDs point into the background area, from the top (114) or bottom (125).

It may be desireable to have additional illumination of the sign from the central area, especially if letters such as "E"(110) are included, with central strokes. Central circuit board (118), a double sided board, is provided for this purpose. FIG. 11 shows this board from the side. It supports and powers the LED (122) which is parallel to the board and illuminates the middle stroke of the "E" (110). Additional LEDs (121) are provided for additional illumination of the background area. Where the central circuit board (118) intersects letters, it may be provided with notches (123), so as to allow the end lights to illuminate the letter along its axis. Alternatively, additional lights (120) may be provided, as shown in the "T" (116), for additional illumination of the letter stroke.

The circuit boards (117)–(119) will have traces (131) to power the LEDs or other lights, which may be either connected to pins (130) which will mate with an appropriate socket (not shown), or could be extended onto a finger stock extension of the board.

Figure 13:
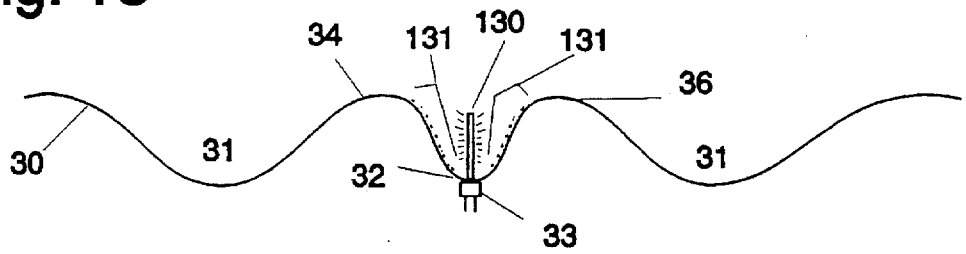
FIG. 13 shows a cut-away side detail of a single letter of a sign in the embodiment using electroluminescent illumination.
Figure 14:
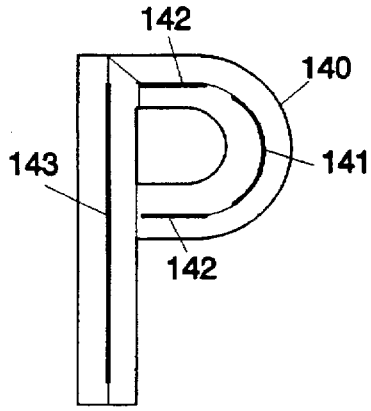
FIG. 14 shows a top view of a letter of a sign in the embodiment using electroluminescent illumination.

FIGS. 13 and 14 show still another variation on the sign of the invention, using electroluminescent display strips in place of the central circuit boards of FIG. 10.

Electroluminescent display strips are commonly used for backlighting on LCD displays in radios, computers or the like. They are flat panels which glow, usually in a bluish or blue-green color, when a voltage is applied. Such panels are available commercially under the "Protolight®" mark from Durel Corp., of Tempe, Ariz., and in a flexible form as "Lumiflex®" strips from Flex Products of Santa Rosa, Calif. The "Indiglo®" backlights on Timex watches are EL lights.

Prior art EL signs have used large flat EL panelswith masking to cover the parts of the sign which are not illuminated letters. A bi-color exit sign has been offered using two electroluminescent panels interlaced, facing the viewer and masked to shape. This use of large panels and masking is quite expensive, in the nature of $350 or more for a simple "EXIT" sign. Smaller EL strips, on the other hand, can be easily incorporated in the sign of the invention, at an affordable cost.

FIG. 14 shows how these strips can be used in the same way as the circuit boards with point light sources such as LEDs shown in the earlier figures. The EL lights are vertically mounted in the center of the letter trough, pointed outwards to illuminate the sloping sides of the trough. The letter "P" (140) shown in FIG. 14 has a long panel with EL lights on both sides (143) down the center of the trough forming the vertical stroke of the letter. Two smaller boards (142) illuminate the short straight parts of the top of the "P", with a flexible EL strip (141) curving around the curved part of the letter.

The EL light strips have a singular advantage for many applications, especially specialized advertising signs, in that they can be supplied in an Ultraviolet (UV) emitting form. FIG. 13 shows how this can be used to advantage. The EL strip (130) is mounted vertically in the center of the letter trough (32), powered by leads inserted into a socket (33) on the rear of the sign board (30). The inward-facing sides of the trough are coated with a UV-sensitive flourescent coating (131), which is commonly available in many colors. The UV light from the EL strip activates the flourescent coating, causing the letter to appear in glowing colors.

Figure 5:
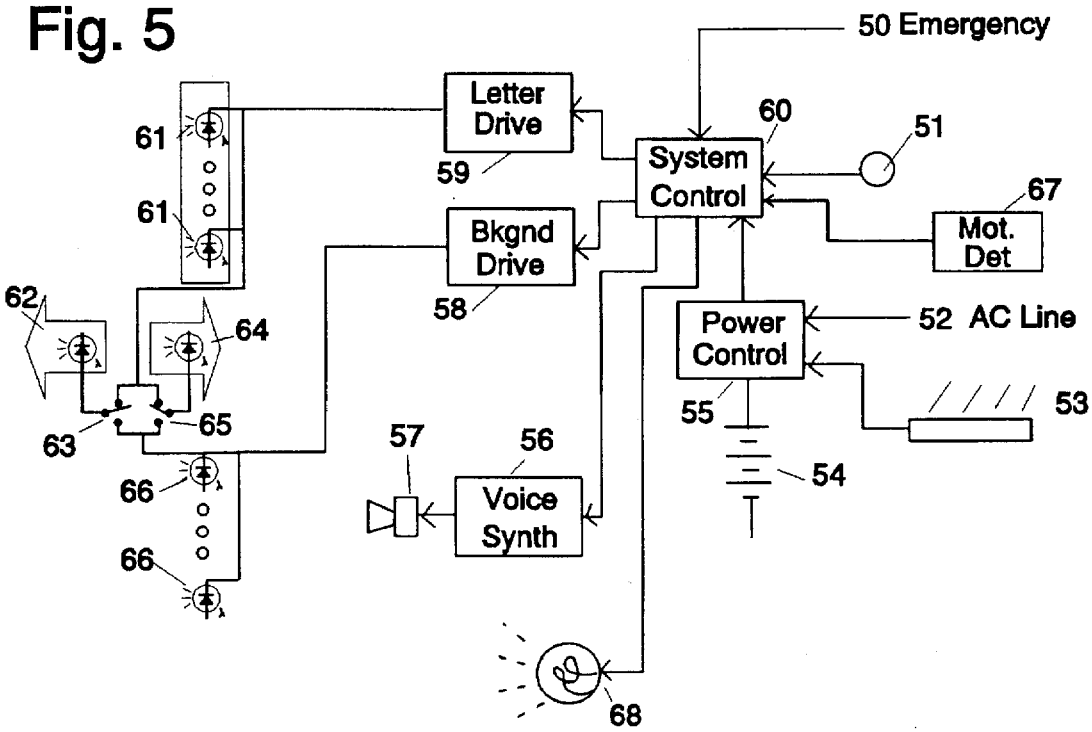
FIG. 5 shows a block diagram of the control circuitry of the invention.

FIG. 5 shows a block diagram of a system for powering the preferred embodiment of the invention. In its simplest state, there need only be a power source (55) and appropriate drive circuitry (59) for the LEDs (61) illuminating the letter strokes.

The LEDs illuminating the left (62) and right (64) arrows will preferably have individual switches (63) and (65), allowing the installer to power the appropriate arrow(s) for wherever the sign is mounted. In the case of a one-color sign, the switches need only be single-pole single-throw (SPST), to turn the appropriate arrow on or off. In the preferred two-color embodiment shown, the switches switch the arrows from foreground color to background color. The single-pole double throw (SPDT) switch arrangement shown would be appropriate when bi-color LEDs are used, simply switching the LEDs from the foreground to the background drive polarity. When the LEDs are switched to foreground color (i.e. red), the arrow stands out from the contrasting background. When switched to the background color (i.e. green), the arrow blends into the background and becomes invisible. It will be recognized by one skilled in the art that the same effect can be achieved with single-color LEDs by putting two sets of LEDs in each arrow, one for each color, and using double-pole single-throw (DPST) switches at (63) and (65) to enable or disable each color LED array.

The power source (55) could work from a power input (52) of 120 VAC ("line voltage"), or 10–20 VAC low voltage power which could use simpler wiring, or even a DC voltage from a central battery backup source, depending on the building application. The power source will then regulate the higher supply voltage down to the 1.5–3 VDC required by the LEDs. Other point light sources may require other voltages, which the ordinary person skilled in the art could derive from the supply voltage using any of the many power supply circuits commercially available or known to the art.

Preferably, if there is no battery backup supply available from the building, a backup battery (54) will be included in the sign, charged by the power source (55) from the line (52).

In addition to the energy savings realized due to maximizing the use of the generated light, the present invention may optionally be capable of utilizing the available light which is essentially always present in the areas of an exit sign installation. A significant power savings can be realized by incorporating a system whereby a photovoltaic panel (53) is placed in the top of the closest lighting fixture or the most suitable spot given the specific location of each individual sign. The purpose of this panel would be to charge the battery (54). This battery, charged essentially at no cost, and separate from the power back-up battery, would be available to run the sign without line power whenever it had reached a fully charged condition. This system of photovoltaic charging of a battery meant only for this power saving feature would significantly reduce power consumption by having the sign's electrical power requirements satisfied independent of the building power source for a portion of its operation.

In the preferred embodiment having contrasting illumination of the background areas, the LEDs in the background (66) will preferably be powered by their own driver circuits (58), allowing independent control of the letters and background areas. The letter drive (59) and background drive (58) circuits may be as simple as voltage regulators, or may include polarity switching capability for use with bicolor LEDs, or means for switching between two color strings, if it is desired to flash alternate colors in an emergency.

The system control circuit (60) will be needed for more complicated embodiments of the invention. It may have an input from the building emergency alarm system (51), which could be a simple contact closure, or a voltage derived from the alarm horns or bells from the system. This would be used to trigger either simple flashing of the exit sign lights, or the color reversals discussed above.

Yet another object of the invention is to further minimize power consumption by having the display be on only during times of area occupancy, this being accomplished by combining timing in the system control (60) and possibly by including an input for motion detection circuitry (67). The motion detector could be any one of the many known to the art, from active sonar systems or IR detectors, to entirely passive piezoelectric sensors such as those manufactured by Pennwalt Manufacturing Company.

A voice synthesizer (56), providing an audible voice from a speaker (57) mounted on or near the sign, can provide additional warning as needed. A strobe light (68) can also be provided as an option.

The system control (60) will preferably incorporate an emergency specific, multiple stage, highly recognizable and attention getting operation to the signs functionality as responses to emergency conditions. This will be accomplished by incorporating the following emergency mode responses:

STAGE 1: Normal operation, which will be characterized by having the display be on in one or two colors.

STAGE 2: Power outage operation, which will be characterized by having the display, if two color, switch letter stroke color and background color alternately at a rate of a color switch every one or two seconds. If display is one color, display will blink at the same rate. If sign is voice equipped, appropriate message will be repeated, such as "Building is experiencing a power outage".

STAGE 3: Fire operation, being characterized by rapid blinking of the sign, or, if available, by rapid color reversals. A flashing strobe light, either in an arrow shape indicating the exit direction or in the middle region of the sign, can add to the effect, perhaps accompanied by appropriate voice message, such as "exit in direction of flashing arrow".

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. An illuminated sign comprising:

a sign body comprising a plurality of illuminated letters each having a characteristic shape, and a background area surrounding the letters, each letter comprising a trough formed in the shape of the letter, the trough comprising two spaced-apart edge projections having a length forming the shape of the letter and a height, the inward-facing sides of the edge projections forming sides of the trough and the space therebetween forming the bottom of the trough, and a plurality of light sources located in the ends of the trough forming the letter, facing along the axis of the trough to illuminate the inward-facing sides of the edge projections; and a circuit board centrally mounted intersecting the troughs forming the letters, in which a plurality of light sources are mounted upon both sides of the circuit board.

2. The illuminated sign of claim 1 in which the light sources on the circuit board illuminate the background areas.

3. The illuminated sign of claim 2 in which the circuit board is notched where it intersects the troughs forming the letters such that the illumination of the letter troughs is not obstructed by the board.

4. The illuminated sign of claim 1 in which the light sources on the board illuminate the trough of the letter along the axis thereof from a location between the ends thereof.

5. The illuminated sign of claim 1 in which the light sources are light emitting diodes.

6. The illuminated sign of claim 1 in which the background area is also illuminated.

7. The illuminated sign of claim 6 in which the illuminated background area is in a contrasting color to the letters.

8. The illuminated sign of claim 6 in which the sign body further comprises a margin having an inward facing edge bounding the illuminated background area, the letters have outward-facing sides facing into the background area and the illuminated background area comprises:

a plurality of background border areas formed by the outward-facing sides of the edge projections forming the plurality of letters of the sign and the inward facing edge of the margin, and a plurality of light sources located along the margin of the background area, facing inward to illuminate the opposing background border areas.

9. The illuminated sign of claim 8 in which the light sources are light emitting diodes.

10. The illuminated sign of claim 9 in which the light sources are multicolor light emitting diodes, such that the color of illumination may be chosen by varying the power supply to the diodes.

11. The illuminated sign of claim 1 in which there are two separate groups of light sources in contrasting colors, such that the color of the illumination may be chosen by illuminating either group of light sources.

* * * * *